US010881202B2

(12) United States Patent
Payne

(10) Patent No.: US 10,881,202 B2
(45) Date of Patent: Jan. 5, 2021

(54) SUPPORT FOR CONSTRUCTING A MOVEABLE OFFICE

(71) Applicant: Hugh Payne, Houston, TX (US)

(72) Inventor: Hugh Payne, Houston, TX (US)

( * ) Notice: Subject to any disclaimer, the term of this patent is extended or adjusted under 35 U.S.C. 154(b) by 95 days.

(21) Appl. No.: 15/676,870

(22) Filed: Aug. 14, 2017

(65) Prior Publication Data

US 2019/0125079 A1 May 2, 2019

Related U.S. Application Data

(63) Continuation of application No. 14/492,540, filed on Sep. 22, 2014, now abandoned.

(51) Int. Cl.

| | |
|---|---|
| ***A47B 87/00*** | (2006.01) |
| ***E04B 2/78*** | (2006.01) |
| ***E04C 3/04*** | (2006.01) |

(52) U.S. Cl.

CPC ..... *A47B 87/005* (2013.01); *E04B 2/7818* (2013.01); *E04C 2003/0413* (2013.01); *E04C 2003/0465* (2013.01)

(58) Field of Classification Search

CPC ... A47B 96/14; A47B 96/1433; A47B 96/145; A47B 96/1466; A47B 96/1475; A47B 96/1483; A47B 2096/1491; A47B 87/00; A47B 87/005; A47B 87/007; A47B 47/00; A47B 47/0008; A47B 47/021; A47B 47/027; E04B 2/7818; E04B 2/7809; E04B 2/7827; E04B 2/7836; E04B 2/7845; E04C 2003/0413; E04C 2003/0465; E04C 3/06; Y10T 24/44983

USPC .. 52/220.1, 239, 282.1, 282.2, 282.3, 282.4, 52/282.5, 36.6, 844; 403/300, 303, 344; 211/103, 186; 248/201

See application file for complete search history.

(56) References Cited

U.S. PATENT DOCUMENTS

| | | | | | |
|---|---|---|---|---|---|
| 2,277,792 | A * | 3/1942 | Small | E04B 9/068 | 52/506.09 |
| 3,156,332 | A * | 11/1964 | Cameron | E06B 3/2675 | 52/204.591 |
| 3,160,245 | A * | 12/1964 | Pavlecka | E04C 2/34 | 52/275 |
| 3,160,249 | A * | 12/1964 | Pavlecka | F16B 5/0052 | 52/586.2 |
| 3,288,319 | A * | 11/1966 | Cahill | B65D 7/24 | 217/12 R |
| 3,516,216 | A * | 6/1970 | Galloway | E04B 2/62 | 138/158 |
| 3,557,413 | A * | 1/1971 | Engle | A44B 18/0053 | 24/584.1 |
| 3,585,768 | A * | 6/1971 | Klein | E04B 1/6175 | 52/282.4 |
| 3,789,567 | A * | 2/1974 | Rae | E04B 1/68 | 52/584.1 |

(Continued)

*Primary Examiner* — Jonathan Liu
*Assistant Examiner* — Guang H Guan
(74) *Attorney, Agent, or Firm* — G. Michael Roebuck, PC

(57) ABSTRACT

A support for a moveable office wall is disclosed, the support including but not limited to a plurality of support sections, wherein the plurality of support sections are connectable to form the support, wherein each of the plurality of support sections comprises an inner connecting surface for joining with another inner connecting surface of another support section.

18 Claims, 12 Drawing Sheets

(56) References Cited

U.S. PATENT DOCUMENTS

| | | | | | |
|---|---|---|---|---|---|
| 4,676,038 | A * | 6/1987 | Doyon | A47B 47/0041 | 403/231 |
| 4,967,531 | A * | 11/1990 | Giles | E04B 2/7425 | 52/587.1 |
| 5,150,554 | A * | 9/1992 | Quinlan, Jr. | E04B 2/7433 | 160/351 |
| 5,491,943 | A * | 2/1996 | Vondrejs | E04B 2/7425 | 52/239 |
| 5,881,713 | A * | 3/1999 | Lai | E04D 3/366 | 126/621 |
| 6,385,941 | B1 * | 5/2002 | Power, Jr. | E04C 3/06 | 160/392 |
| 6,601,362 | B1 * | 8/2003 | Prince | E04C 3/06 | 52/844 |
| 6,668,495 | B1 * | 12/2003 | Prince | E04C 3/06 | 160/391 |
| 6,826,885 | B2 * | 12/2004 | Raskin | E04C 3/06 | 403/393 |
| 8,756,900 | B1 * | 6/2014 | Hudson | E04C 3/07 | 52/844 |
| 2015/0136936 | A1 * | 5/2015 | Payne | E04B 2/7818 | 248/558 |
| 2019/0125079 | A1 * | 5/2019 | Payne | E04B 2/7818 | |

* cited by examiner

SUPPORT FOR CONSTRUCTING A MOVEABLE OFFICE

CROSS REFERENCE TO RELATED APPLICATIONS

This patent application is a continuation of U.S. patent application Ser. No. 14/492,540 entitled A Support for Constructing a Moveable Office filed on Sep. 22, 2014 by Hugh Payne, which hereby incorporated by reference in its entirety.

BACKGROUND OF THE INVENTION

Cubicles and offices with office walls are used to house corporate employees in hard-walled offices and cubicles. There is a need for an efficient and cost effective way to install these cubicles and offices.

SUMMARY OF THE INVENTION

The present invention provides a moveable and demountable support post that can be configured to support office components including but not limited to cubicle walls, office walls, hinged doors, sliding door and clear panels.

DETAILED DESCRIPTION OF THE INVENTION

Figure 1:
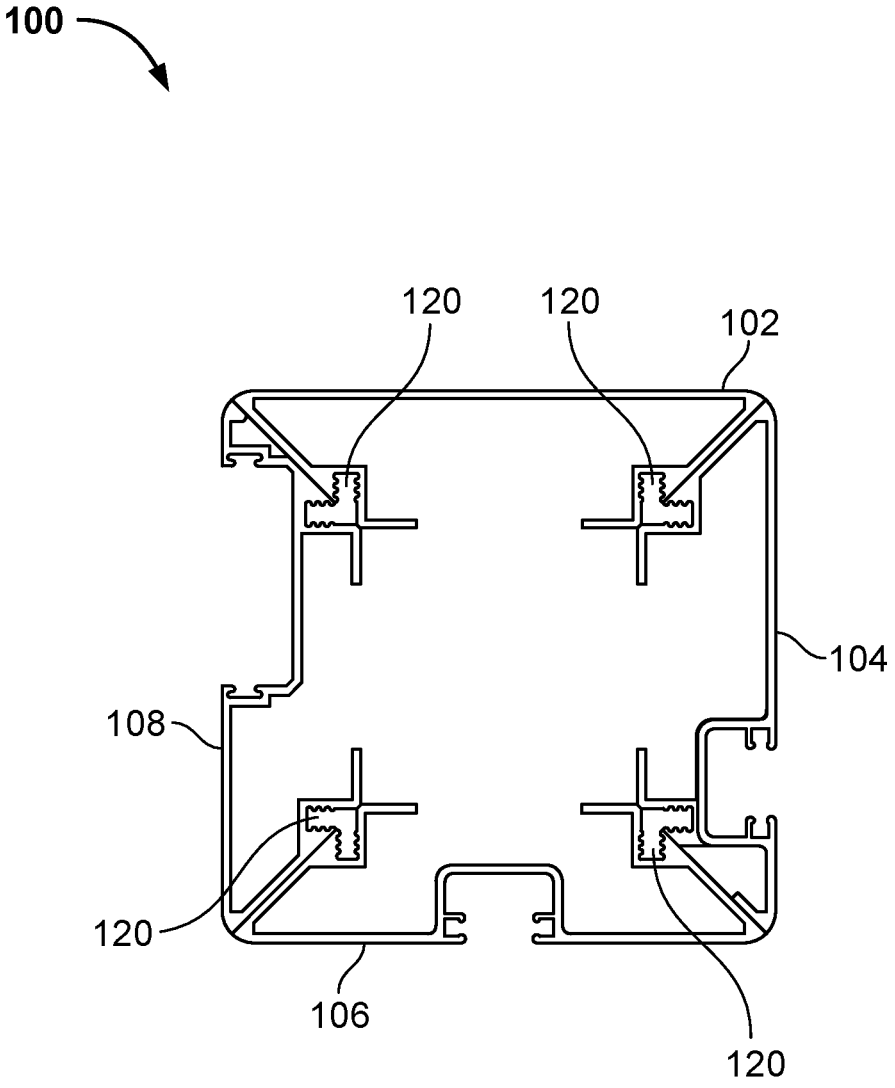
FIG. 1 is a schematic depiction of an illustrative embodiment of the invention.

In a particular embodiment, a support for a moveable office wall is disclosed, the support including but not limited to a plurality of support sections, wherein the plurality of support sections are connected to form the support, where in each of the plurality of sections includes but is not limited to an inner connecting surface for joining with an inner connecting surface of an adjacent support section. In another embodiment of the support, each one of the plurality of support sections further includes but is not limited to a longitudinal connector for joining the inner connecting surfaces of adjacent support sections to form the support. In another embodiment of the support, at least one of the plurality of support sections has a solid outer support surface is solid surface. In another embodiment of the support, one of the plurality of support sections has a solid outer support surface with a vertical slot formed in the outer support surface to accept one of a plurality of office components. In another embodiment of the support, each of the plurality of support sections are interchangeable so that the support can reconfigured by changing support sections.

In another embodiment of the support, the support is a longitudinal support that resists a force perpendicular to an outside surface of the longitudinal support between the inner connecting surfaces of adjacent vertical wall sections. In another embodiment of the present invention, a method for assembling a support for a moveable office wall is disclosed, the method including but not limited to joining a plurality of support sections, wherein the plurality of support sections are connectable to form the support, where in each of the plurality of sections comprises an inner connecting surface for joining with another inner connecting surface of another support section. In another embodiment of the method, each one of the plurality of support sections further includes but is not limited to a longitudinal connector for joining the inner connecting surfaces of adjacent support sections to form the support. In another embodiment of the method, at least one of the plurality of support sections has a solid outer support surface is solid surface In another embodiment of the method, at least one of the plurality of support sections has a solid outer support surface with a vertical slot formed in the outer support surface to accept one of a plurality of office components. In another embodiment of the method, each of the plurality of support sections are interchangeable with other and different support sections so that the support can reconfigured by changing a first support section with a second support section, wherein the first and second support sections are different from each other. In another embodiment of the method, the longitudinal support resists a force perpendicular to an outside surface of the support between the inner connecting surfaces of adjacent vertical wall sections. Each of the supports include two or more sections that are joined together internally with a longitudinal connector that slides into adjacent support sections to connect the sections and form the support. In one embodiment a support is made of four quarter support sections that are joined together form a support.

In another embodiment the support is made of two half support sections that are joined together to form a support. Each half support section has an inner connection surface for joining it with other adjacent support sections having a similar connection surface to form a support. A longitudinal connector slides into the each connection surface of adjacent support sections to connect the adjacent support sections. A longitudinal connector can be removed from adjacent support sections to disassemble a support or to replace one of the support sections and reconfigure the support.

In a particular embodiment a first one of the support sections has a flat outer surface and a second one of the support sections has a slotted outer surface for supporting one of a plurality of office components. The office components include but are not limited to cubicle walls, office walls, hinged doors, sliding door and clear panels. Thus, the support sections be selected and joined to configure a support to accommodate any of the office components, the support sections selected having an exterior surface including but not limited to a flat external surface, a slot for receiving a moveable wall support, a slot for receiving a window support and a slot for receiving sliding glass door support interface for receiving a sliding glass door. Additional slots in additional support sections can be configured to receive additional office components now available or available in the future.

In a particular embodiment, a seam is formed between support sections, over which a longitudinal piece is inserted to hide the seam formed between the support sections. In the present examples, the support is a vertical support. The support is reusable and reconfigurable. The support can be easily disassembled and reconfigured to accommodate a new configuration to replace a support section having a flat surface with a support section having a slot to accommodate an office component. The support can be easily disassembled into support sections and reconfigured with one or more different support sections to form a new support that accommodates a new office configuration. Supports are reconfigured to replace an old support configuration with a new support configuration to accommodate an additional office wall when an adjoining office is added. The support sections are fixed together using a removable longitudinal connector that slides between adjacent support sections and fixes the adjacent support sections together to form a support until the support is removed to reconfigure the support or relocated to form another moveable office. In the present example the support is a square post. This is by example only as the support can be other shapes including but not limited to a round, oblong or irregular shaped support. The present invention can also be used to form supports that are not vertical. A support formed from the support sections can be positioned at angles that are now vertical.

A method and apparatus are disclosed for assembling support sections to construct a support for supporting office components of a moveable office. In particular embodiment the present invention is advantageous over modular office systems in that the present invention can be assembled from support sections on hand rather that ordering modular office walls and supports such as corner posts to be made at a factory and subsequently delivered to be assembled at a construction site.

Turning now to FIG. 1, a particular illustrative embodiment of a support 100 of the present invention is schematically depicted. In the particular illustrative embodiment depicted in FIG. 1, four support quarter sections 102, 104, 106 and 108 are joined together internally with longitudinal connectors 120. The longitudinal connectors slides in to adjacent support quarter sections to fix them with respect to each other. In a particular embodiment the longitudinal connectors 120 are made of polyvinyl chloride. In another particular embodiment the longitudinal connectors are made of extruded aluminum. In another particular embodiment the support quarter sections 102, 104, 106 and 108 are made of extruded aluminum. The longitudinal connectors can be made of other materials presently known or unknown.

Figure 2:
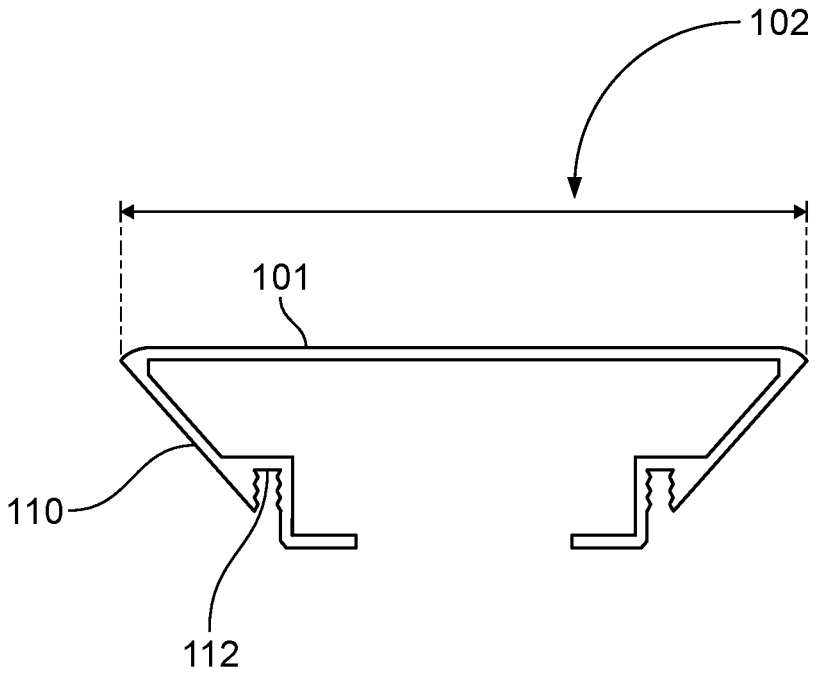
FIG. 2 is a schematic depiction of another illustrative embodiment of the invention.

Turning now to FIG. 2, a detailed schematic depiction of quarter section 102 is depicted. In a particular illustrative embodiment, the quarter section 102 has a flat exterior face 101 and an internal wall face bent at 45 degrees to form angular bend 110. The angular bend 110 fits geometrically with an adjacent quarter section having a similar 45 degree bend 110. A longitudinal connector fitting space 112 forms a space wherein on of the longitudinal connectors 120 fits internally between adjacent quarter sections. For example quarter, longitudinal connector 120 slides into both sections 102 and 104, as shown in FIG. 1 to affix the quarter sections 102 and 104 in place with respect to one another. Similarly quarter sections 104 and 106, 106 and 108 and 108 and 102 are joined internally with a longitudinal connector 120. The four quarter sections are joined together for form a support 100.

Figure 3:
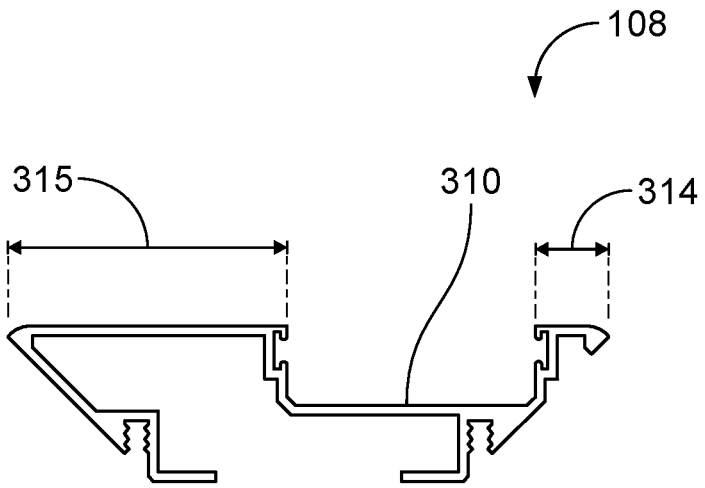
FIG. 3 is a schematic depiction of another illustrative embodiment of the invention.

Turning now to FIG. 3, a detailed schematic depiction of quarter section 108 is illustrated. As show in FIG. 3, quarter section 108 has an opening 310, also referred to herein as a slot, for receiving an office component such as a door edge for a sliding glass door. In a particular illustrative embodiment the opening 310 is not centered between the edges of the support exterior surface on the exterior surface of quarter section 310. A first end of opening 310 is a distance 314 from a right edge and corner of quarter section 108 and a second end of opening 310 is a distance 315 from a left corner and edge of the outside surface of quarter section 108, wherein distance 315 is greater than distance 314.

Figure 4:
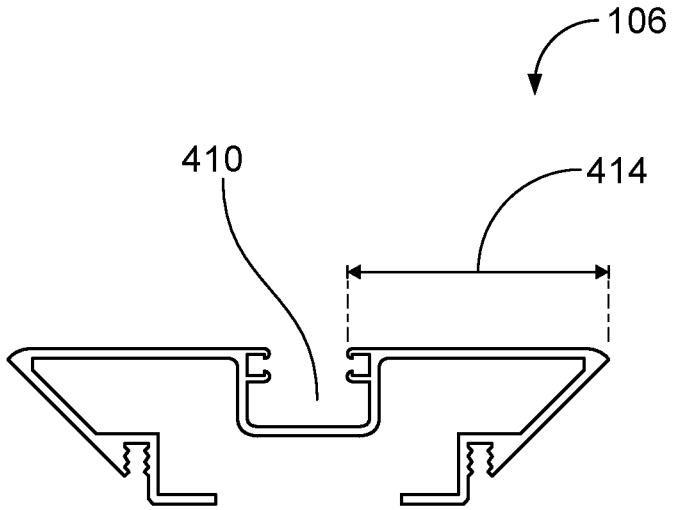
FIG. 4 is a schematic depiction of another illustrative embodiment of the invention.

Turning now to FIG. 4, a detailed depiction of quarter section 106 is illustrated. As show in FIG. 4, quarter section 106 has an opening or slot 410 for receiving an office component such as a window edge. The opening 410 is smaller in width than the opening 310, as 410 receives a window edge which smaller in width than a door edge which is received by opening 310. In a particular illustrative embodiment of FIG. 4 the opening 310 is centered on an exterior surface of quarter section 106. A first end of opening 410 is a distance 414 from a right corner of quarter section 106 and a second end of opening 410 is an equal distance 414 from a left corner of quarter section 106.

Figure 5:
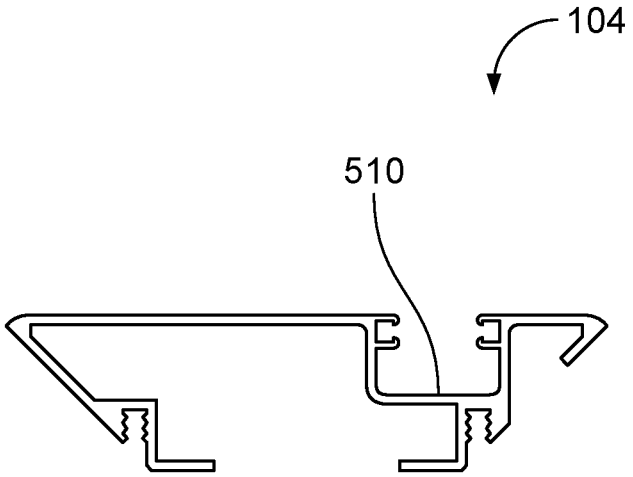
FIG. 5 is a schematic depiction of another illustrative embodiment of the invention.

Turning now to FIG. 5, a detailed depiction of quarter section 104 is illustrated. As show in FIG. 5, quarter section 104 has an opening or slot 510 for receiving an office component such as a window edge. The opening or slot 510 is smaller in width than the opening 310 as the slot 510 is designed to receive a clear panel or window edge which smaller in width than the door edge which is received by slot 310. In the particular illustrative embodiment depicted in FIG. 5 the opening 510 is not centered on the exterior surface of quarter section 106. A first end of the opening 510 is closer to a right corner of quarter section 104 exterior surface and a second end of opening 510 is farther from a left edge of the exterior surface of the corner of quarter section 104.

Figure 6:
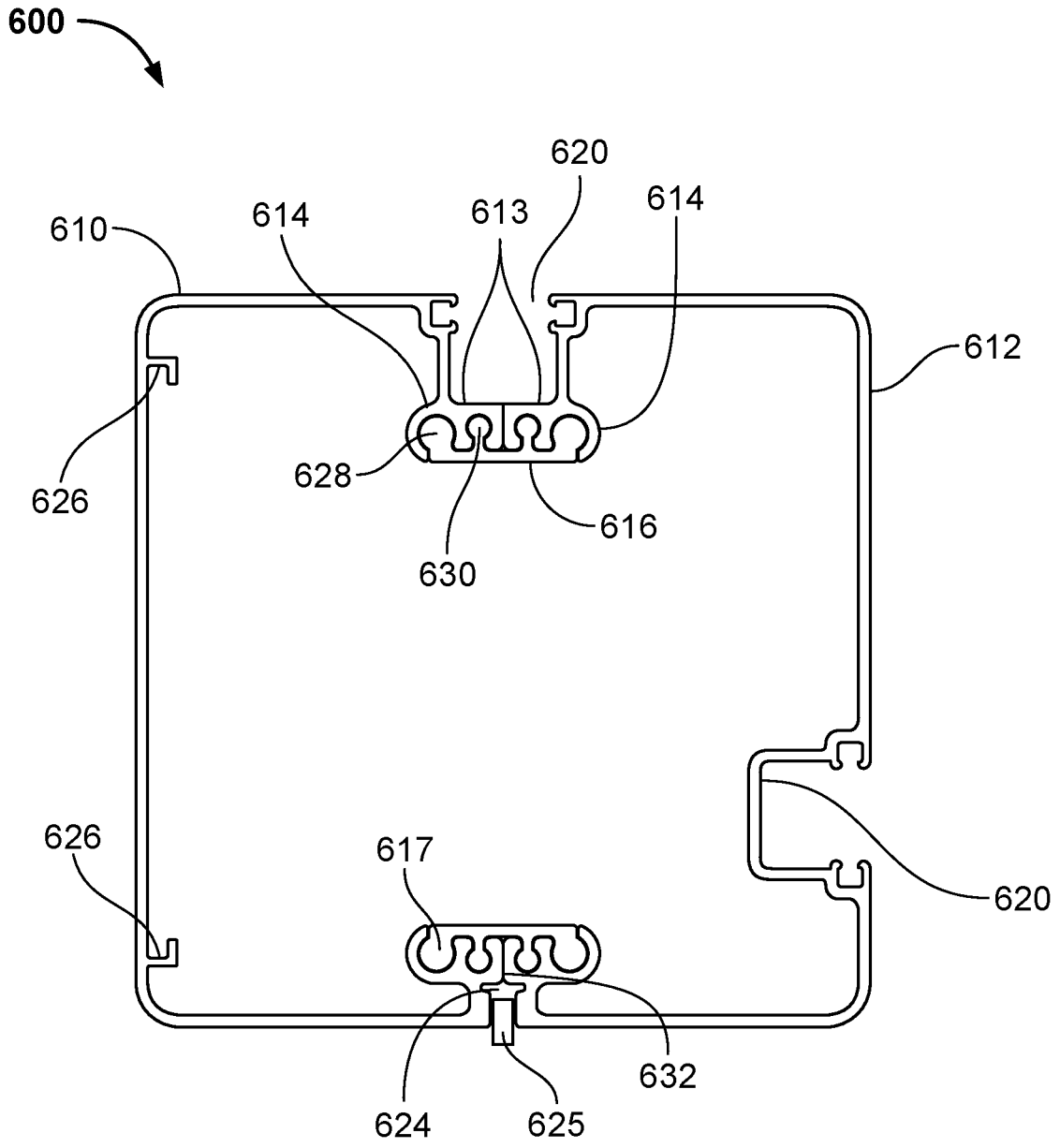
FIG. 6 is a schematic depiction of another illustrative embodiment of the invention.

Turning now to FIG. 6, in a particular illustrative embodiment another embodiment of a support is formed by attaching two support half sections 610 and 612 together as shown in FIG. 6 to form a support 600. In the present example the support is a vertical square post 600. Vertical support half sections 610 and 612 are held together internally by a first longitudinal connector 616 and a second longitudinal connector 617. As shown in FIG. 6, each support half section 610 and 612 has an internal connector recipient housing 614 that is formed in the shape of the longitudinal connectors 616 and 617. Longitudinal connectors 616 and 617 slide into adjacent internal connector recipient housings 614 to removably fix the support half sections 610 and 612 together. A seam 632 is formed between adjacent surfaces of half sections 610 and 612 joined by longitudinal connectors 616 and 617. As shown in FIG. 6, in a particular embodiment, an opening 624 is formed by the joining of support half sections 610 and 612. An insert 625 snaps into opening 624 to hide the seam 632 so that the seam 632 is not visible from the outside view of the support.

In a particular embodiment, the longitudinal connector 616 has four raised interlocking members (also referred to as "toes") that engage internal connector recipient housing 614. Two of the interlocking members 630 or toes, are positioned between interlocking members 628. Interlocking members 630 are smaller in diameter (also referred to as small toes) than the interlocking members 628 (also referred to as big toes). Interlocking members 630 are the same size as a number 10 fastening screw, so that a number 10 screw can be used in place of the longitudinal connector 616 to fasten an overhead ceiling grid to the internal connector recipient housing 614 to fix the support to an overhead ceiling grid. A screw is rotated into the internal connector recipient housing 616 in place of the interconnecting member 630 to fix the corner post to an overhead ceiling grid.

Figure 7:
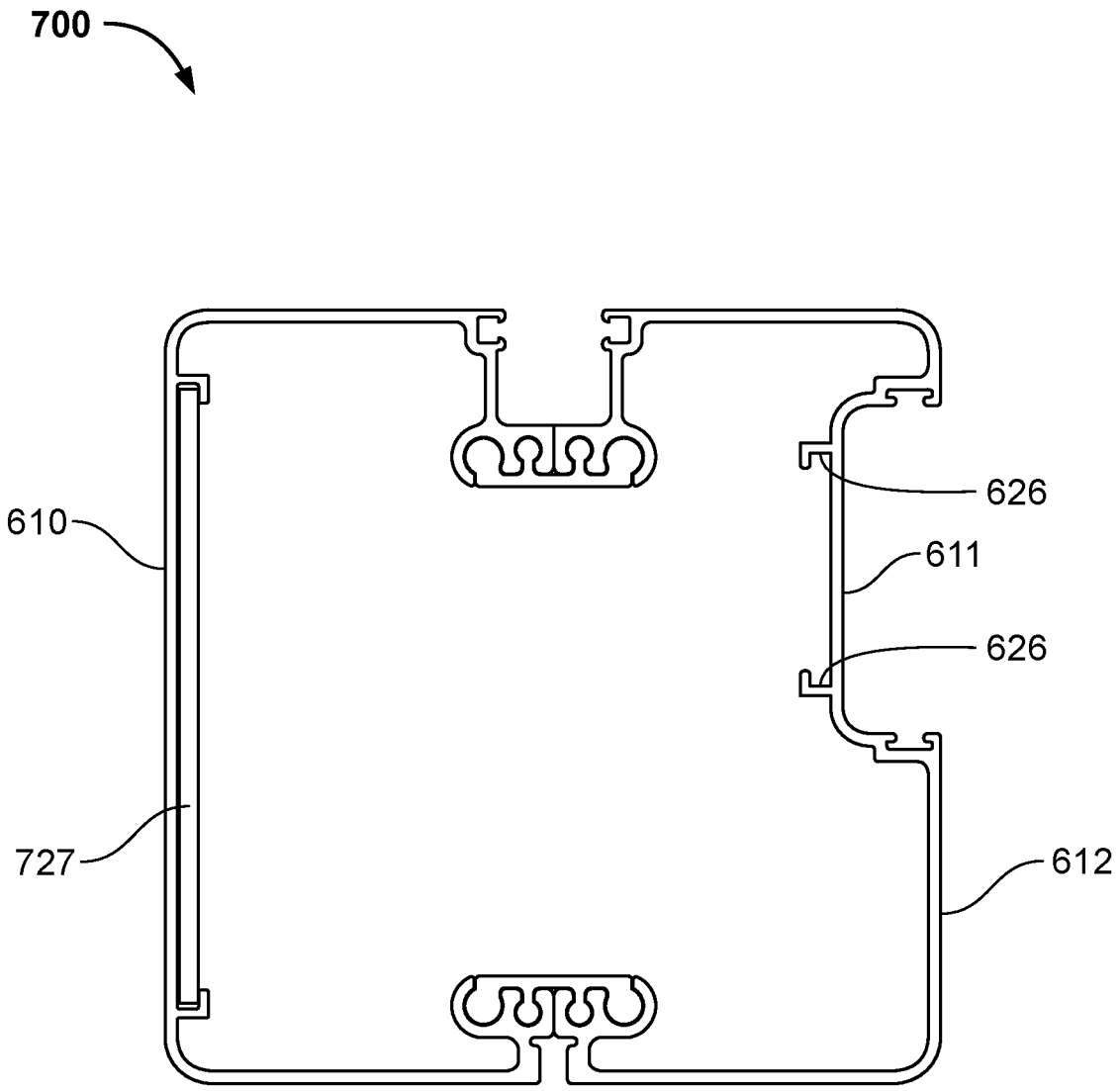
FIG. 7 is a schematic depiction of another illustrative embodiment of the invention.

As shown in FIG. 6 support adjacent half sections 610 and 612 fit together so that support half section pieces 613 are joined together and form a base for opening 620 which is formed to receive a furniture component such a clear panel edge. Reinforcement slots 626 are formed on the interior of corner post halve 610. As shown in FIG. 7, the reinforcement slots are formed to receive a reinforcing member such as a ⅛ inch thick aluminum plate 727 to reinforce support half section 610. The support is reinforced using the slots 626 and plate such as a ⅛ inch aluminum plate 727 that fits into the slots 626 inside of the support, to reinforce the support when the support is used for attaching a pair of hinges for attaching a frameless door to the corner post.

Figure 8:
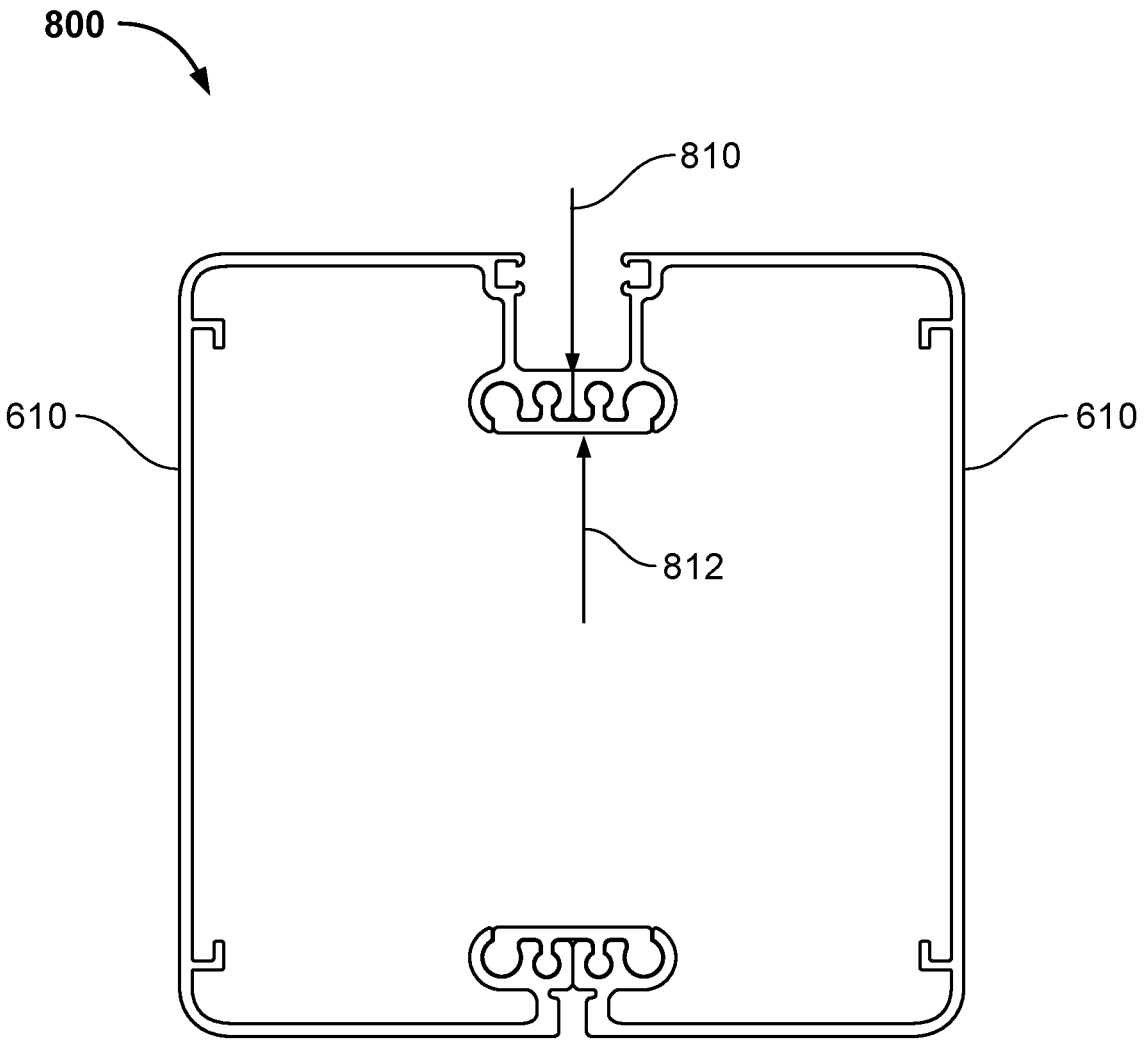
FIG. 8 is a schematic depiction of another illustrative embodiment of the invention.

Turning now to FIG. 7, another illustrative embodiment 700 of the invention is depicted wherein a large opening 611 is formed in the half section 612. The opening 611 is designed to receive a wider furniture component such as sliding door. Turning now to FIG. 8, as shown in FIG. 8 in a particular illustrative embodiment 800, internal connector 616 having four nodes, two nodes 628 and two nodes 630. The four nodes of 616 slide into internal connector recipient housings 614 to fix stabilize the connection between half sections 610 of internal connector 616 to reinforce the joinder of the half sections to resist buckling or deformation from an inward force 810 and an outward force 812.

Figure 9:
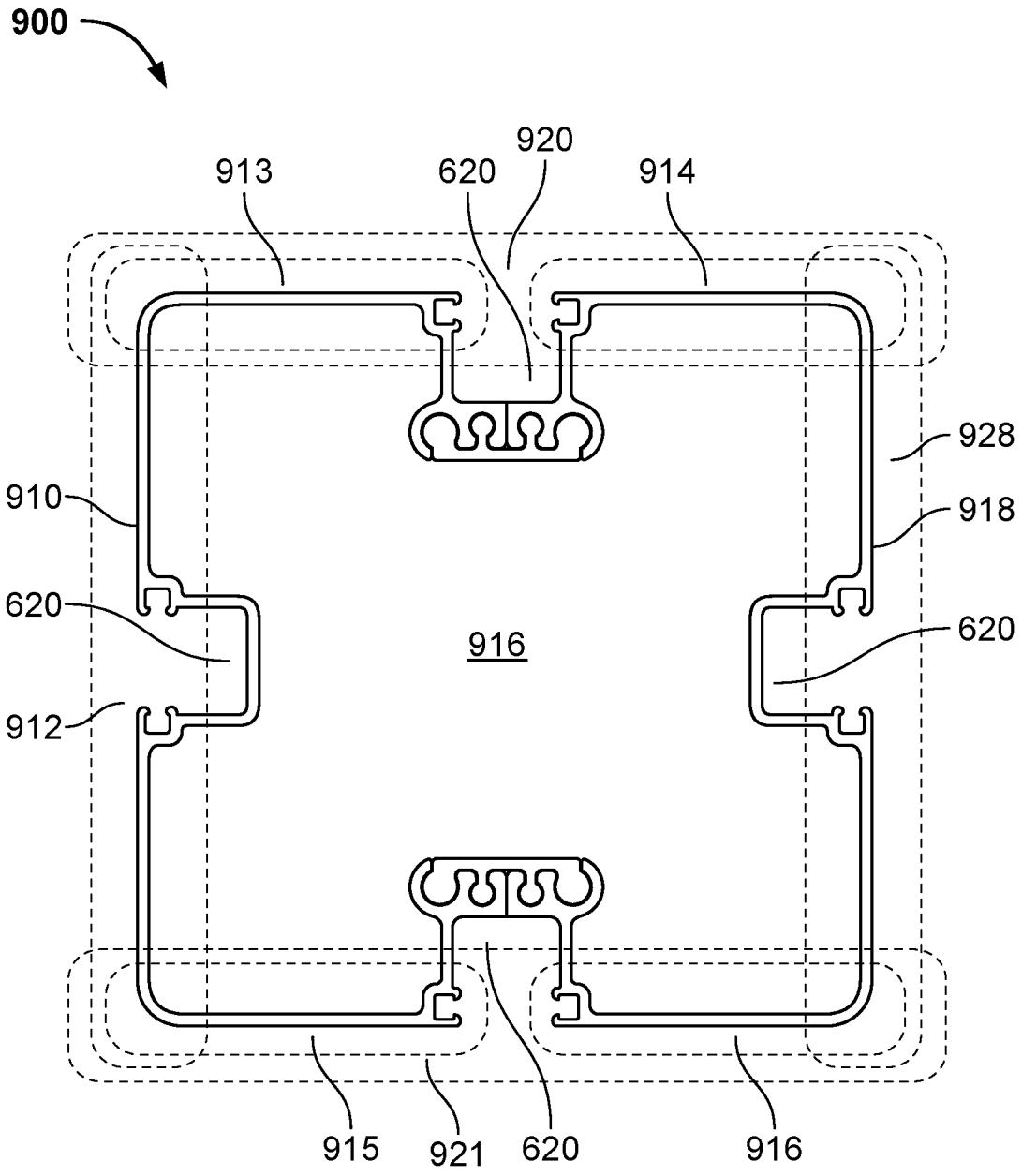
FIG. 9 is a schematic depiction of another illustrative embodiment of the invention.

Turning now to FIG. 9, in another particular embodiment 900, two half section pieces 910 and 918 are joined together to form a four-sided enclosed vertical support for a moveable office wall. As shown in FIG. 9, in another embodiment 900, four openings 620 are formed by the joinder of half section pieces 910 and 918. As shown in FIG. 9, a first vertical support half section 910 has a first side 912 forming a first vertical wall, a second side 913 forming a second vertical wall and a third side 915 forming a third vertical wall and a second vertical support half section 918 has a first side 914 forming a first vertical wall, a second side 928 forming a second vertical wall and a third side 916 forming a third vertical wall. An enclosed space 916 is formed inside the vertical support. The two half sections 910 and 918 when joined together form a four wall support section with an interior space 916 enclosed by the four walls 920, 928, 921 and 912.

Figure 10:
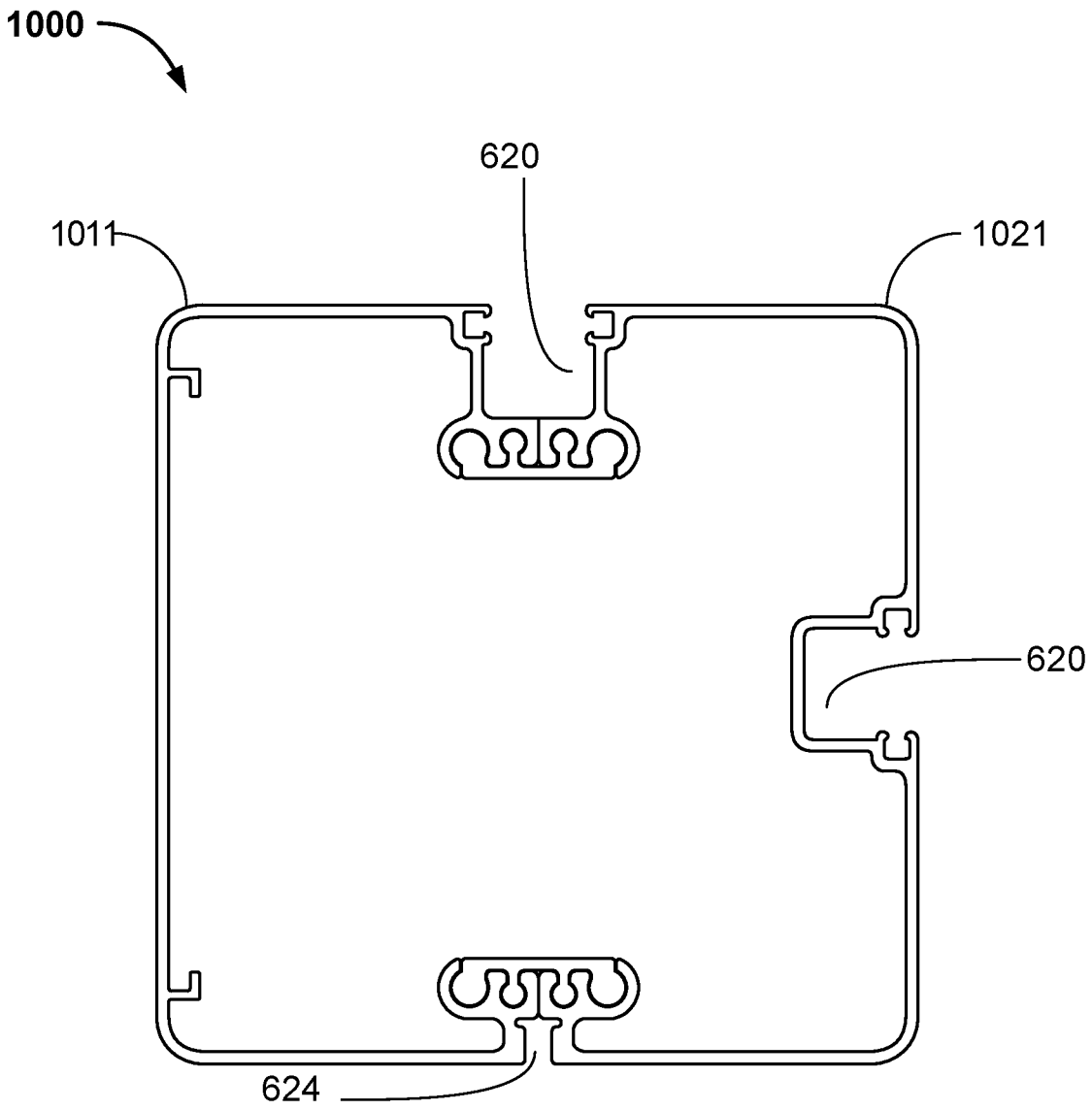
FIG. 10 is a schematic depiction of another illustrative embodiment of the invention.
Figure 11:
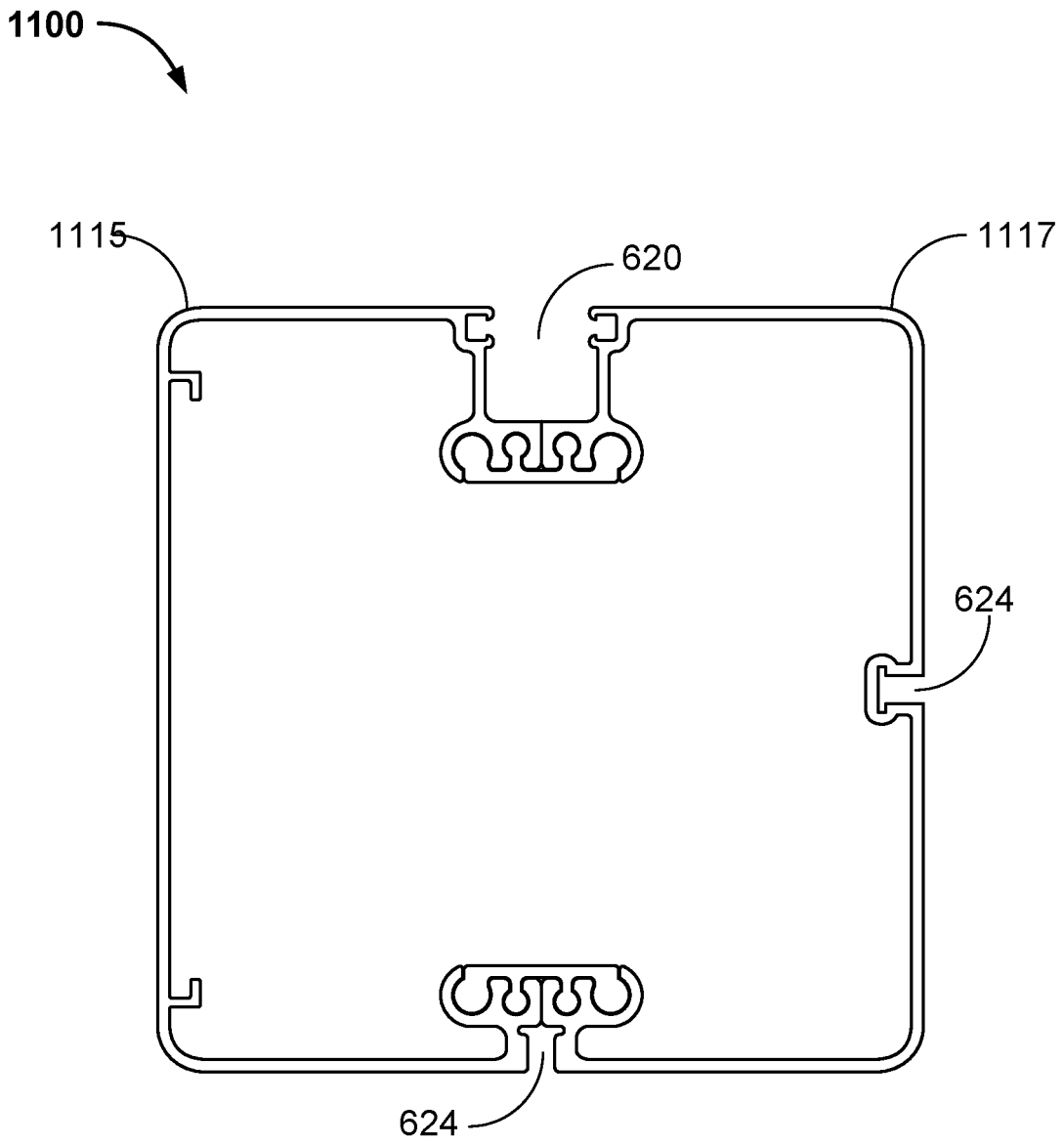
FIG. 11 is a schematic depiction of another illustrative embodiment of the invention.
Figure 12:
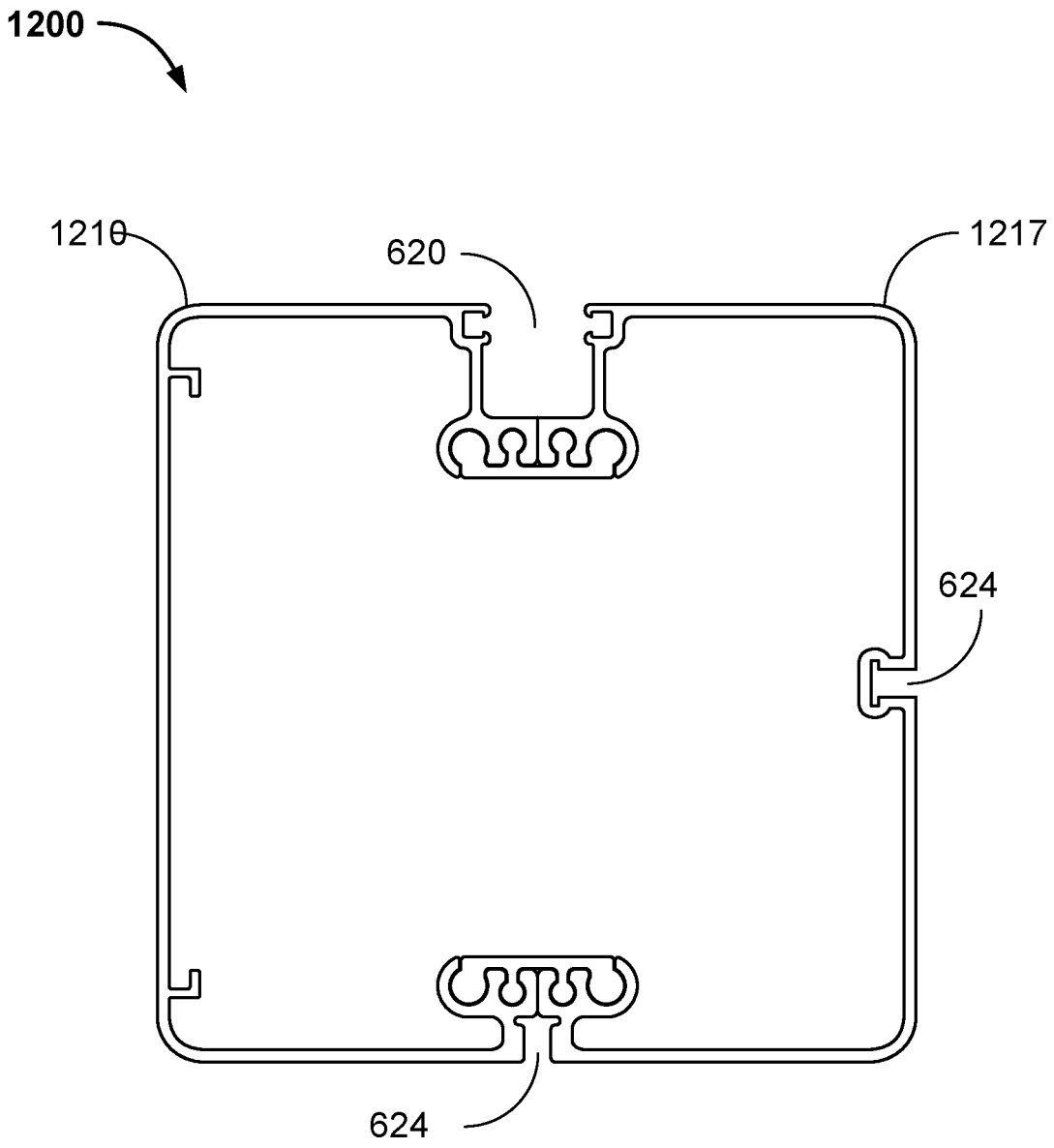
FIG. 12 is a schematic depiction of another illustrative embodiment of the invention.

Turning now to FIG. 10 in another embodiment 1000 shows the joinder of half sections 1011 and 1021 to form two openings 620 and one small opening 624. Turning now to FIG. 11 in another embodiment 1100 shows the joinder of half sections 1115 and 1117 to form one opening 620 and two small openings 624. Turning now to FIG. 12 in another embodiment 1200 shows the joinder of corner post halves 1210 and 1217 to one opening 620 and two small openings 624.

Figure 13:
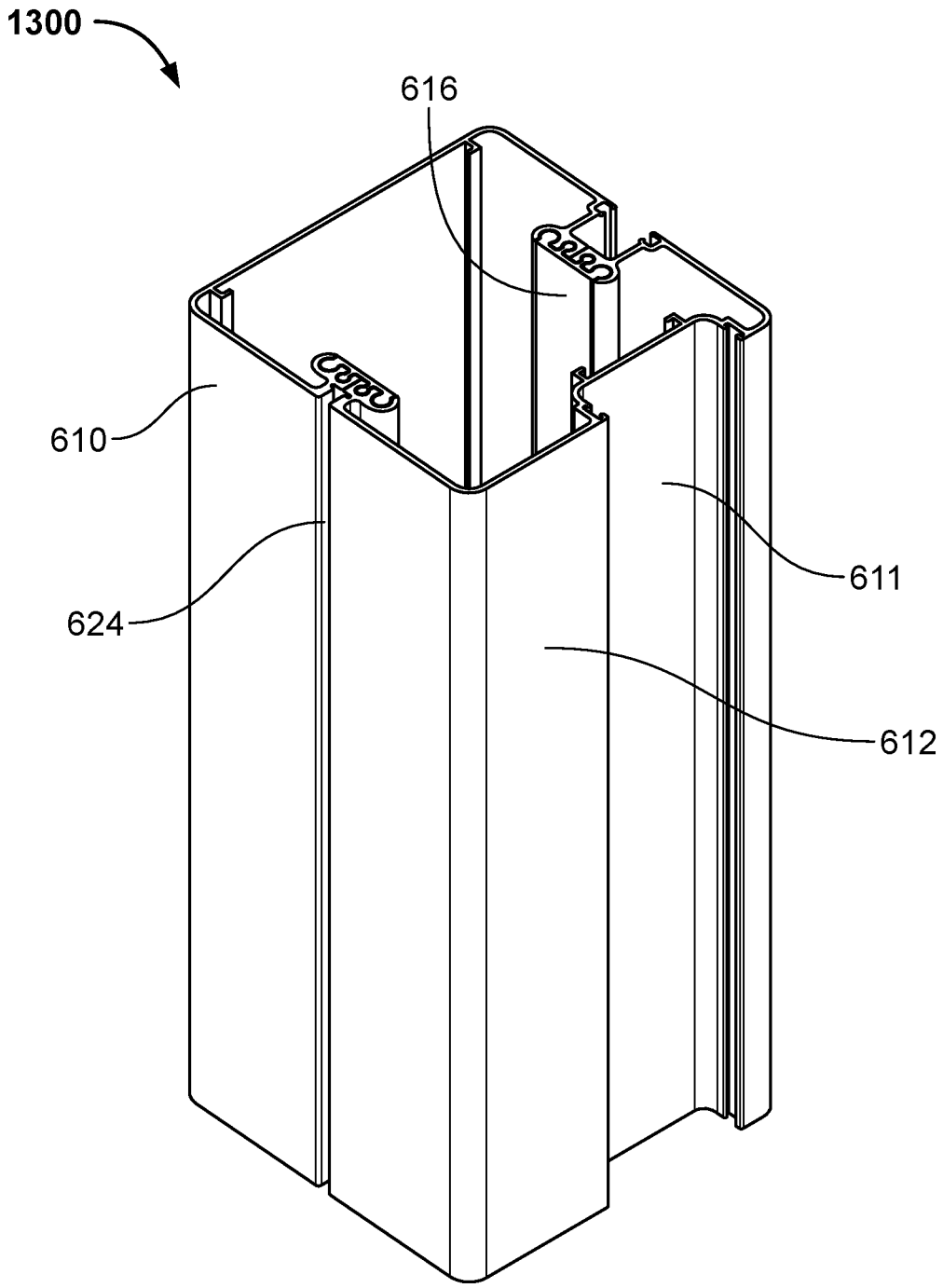
FIG. 13 is a schematic depiction of another illustrative embodiment of the invention.

Turning now to FIG. 13, the embodiment of FIG. 8 shown in a perspective view 1300 depicting a support formed by half sections 610 and 612 joined together by internal connectors 616.

The foregoing description is not meant to limit the invention but to illustrate examples of the invention. Other may with the aid of this disclosure use different embodiments that are within the scope of the invention and the appended claims.

The invention claimed is:

1. A four-sided enclosed vertical support comprising:

a first vertical support member including a first vertical section, a second vertical section, and a third vertical section;

a second vertical support member connected to the first vertical support member, the second vertical support member including a first vertical section, a second vertical section, and a third vertical section;

an enclosed interior space inside of four sides of the four-sided enclosed vertical support, wherein each of the four sides partially defines the enclosed interior space, wherein a first side of the four sides is defined by the first vertical section of the first vertical support member and the first vertical section of the second vertical support member, wherein a second side of the four sides is defined by the second vertical section of the first vertical support member, wherein a third side of the four sides is defined by the third vertical section of the first vertical support member and the third vertical section of the second vertical support member, and wherein a fourth side of the four sides is defined by the second vertical section of the second vertical support member;

a first bracket member extending from the second vertical section of the first vertical support member into the enclosed interior space and partially defining a first longitudinal reinforcement slot;

a second bracket member extending from the second vertical section of the first vertical support member into the enclosed interior space and partially defining a second longitudinal reinforcement slot;

a first longitudinal reinforcement plate slidably disposed within the first longitudinal reinforcement slot and the second longitudinal reinforcement slot; and a first longitudinal connector connecting the first vertical support member to the second vertical support member, wherein the first longitudinal connector includes a first connector portion, a second connector portion, a third connector portion, and a fourth connector portion;

wherein the first vertical section of the first vertical support member includes a receiver portion extending inwardly toward the third vertical section of the first vertical support member, wherein the first vertical section of the second vertical support member includes a receiver portion extending inwardly toward the third vertical section of the second vertical support member, wherein the receiver portion of the first vertical section of the first vertical support member and the receiver portion of the first vertical section of the second vertical support member directly contact each other and together define a first vertical slot for receiving a first panel component, wherein the receiver portion of the first vertical section of the first vertical support member includes a first internal connector recipient housing extending inwardly from the first vertical slot toward the third vertical section of the first vertical support member and receiving the first and second connector portions of the first longitudinal connector, wherein the receiver portion of the first vertical section of the second vertical support member includes a second internal connector recipient housing extending inwardly from the first vertical slot toward the third vertical section of the second vertical support member and receiving the third and fourth connector portions of the first longitudinal connector.

2. The four-sided enclosed vertical support of claim 1, wherein the second vertical section of the second vertical support member includes a recessed portion extending inwardly toward the second vertical section of the first vertical support member, and wherein the recessed portion defines a second vertical slot for receiving a second panel component.

3. The four-sided enclosed vertical support of claim 2, further comprising:

a third bracket member extending from a base segment of the recessed portion of the second vertical section of the second vertical support member into the enclosed interior space and partially defining a third longitudinal reinforcement slot; and a fourth bracket member extending from the base segment of the recessed portion of the second vertical section of the second vertical support member into the enclosed interior space and partially defining a fourth longitudinal reinforcement slot;

wherein the third longitudinal reinforcement slot and the fourth longitudinal reinforcement slot cooperate with each other to receive a second longitudinal reinforcement plate slidably disposed therein.

4. The four-sided enclosed vertical support of claim 3, wherein the first bracket member is spaced apart from the second bracket member at a first distance, wherein the third bracket member is spaced apart from the fourth bracket member at a second distance, wherein the first distance is greater than the second distance.

5. The four-sided enclosed vertical support of claim 3, wherein each of the first, second, third, and fourth bracket members is substantially L-shaped.

6. The four-sided enclosed vertical support of claim 3, wherein the second vertical slot has a slot width greater than a slot width of the first vertical slot.

7. The four-sided enclosed vertical support of claim 6, wherein the second vertical slot is configured to receive a sliding door.

8. The four-sided enclosed vertical support of claim 1, wherein the first vertical slot is configured to receive an office wall edge or an office door edge.

9. The four-sided enclosed vertical support of claim 1, wherein the first longitudinal reinforcement plate is an aluminum plate.

10. The four-sided enclosed vertical support of claim 1, wherein the first internal connector recipient housing is in direct contact with the second internal connector recipient housing.

11. The four-sided enclosed vertical support of claim 1, wherein each of the first and second bracket members is substantially L-shaped.

12. The four-sided enclosed vertical support of claim 1, further comprising:

a second longitudinal connector connecting the first vertical support member to the second vertical support member.

13. The four-sided enclosed vertical support of claim 12, wherein the third vertical section of the first vertical support member includes a receiver portion extending inwardly toward the first vertical section of the first vertical support member, wherein the third vertical section of the second vertical support member includes a receiver portion extending inwardly toward the first vertical section of the second vertical support member, wherein the receiver portion of the third vertical section of the first vertical support member includes a third internal connector recipient housing receiving a first plurality of connector portions of the second longitudinal connector, and wherein the receiver portion of the third vertical section of the second vertical support member includes a fourth internal connector recipient housing receiving a second plurality of connector portions of the second longitudinal connector.

14. The four-sided enclosed vertical support of claim 1, wherein the four-sided enclosed vertical support is a vertical post with a substantially square cross-sectional shape.

15. The four-sided enclosed vertical support of claim 1, wherein the first longitudinal connector is configured to slide into the first internal connector recipient housing and the second internal connector recipient housing for reinforcing the connection of the first and second vertical support members to resist buckling or deformation from an inward force or an outward force.

16. The four-sided enclosed vertical support of claim 1, wherein the first connector portion of the first longitudinal connector is a first connector toe, wherein the second connector portion of the first longitudinal connector is a second connector toe, wherein the third connector portion of the first longitudinal connector is a third connector toe, and wherein the fourth connector portion of the first longitudinal connector is a fourth connector toe.

17. The four-sided enclosed vertical support of claim 16, wherein the first connector toe is greater in diameter than the second connector toe, and wherein the fourth connector toe is greater in diameter than the third connector toe.

18. The four-sided enclosed vertical support of claim 17, wherein the second and third connector toes are arranged between the first and fourth connector toes.

* * * * *